US008600085B2

(12) United States Patent
Chen et al.

(10) Patent No.: US 8,600,085 B2
(45) Date of Patent: Dec. 3, 2013

(54) AUDIO PLAYER WITH MONOPHONIC MODE CONTROL

(75) Inventors: Shaohai Chen, Cupertino, CA (US); Phillip George Tamchina, Mountain View, CA (US); Jae Han Lee, San Jose, CA (US)

(73) Assignee: Apple Inc., Cupertino, CA (US)

( * ) Notice: Subject to any disclaimer, the term of this patent is extended or adjusted under 35 U.S.C. 154(b) by 967 days.

(21) Appl. No.: 12/356,483

(22) Filed: Jan. 20, 2009

(65) Prior Publication Data

US 2010/0183175 A1 Jul. 22, 2010

(51) Int. Cl.
*H04R 5/02* (2006.01)
*H04R 5/033* (2006.01)
*H04R 5/00* (2006.01)

(52) U.S. Cl.
USPC ..... 381/309; 381/384

(58) Field of Classification Search
USPC ..... 381/309, 380, 384
See application file for complete search history.

(56) References Cited

U.S. PATENT DOCUMENTS

| | | | | |
|---|---|---|---|---|
| 4,955,729 | A * | 9/1990 | Marx | 381/322 |
| 5,144,678 | A * | 9/1992 | Lenz | 381/384 |
| 6,711,268 | B2 * | 3/2004 | Colegrave et al. | 381/74 |
| 7,418,103 | B2 | 8/2008 | Sargaison | |
| 2006/0029234 | A1 * | 2/2006 | Sargaison | 381/74 |
| 2006/0045304 | A1 * | 3/2006 | Lee et al. | 381/384 |
| 2010/0020998 | A1 * | 1/2010 | Brown et al. | 381/380 |
| 2010/0315211 | A1 * | 12/2010 | Le-Faucheur | 340/407.1 |

* cited by examiner

*Primary Examiner* — Edgardo San Martin
(74) *Attorney, Agent, or Firm* — Blakely, Sokoloff, Taylor & Zafman LLP

(57) ABSTRACT

An audio player includes an audio headset having two earpieces. A playback circuit provides one of a stereophonic program and a monaural program to the audio headset. The monaural program may be created by mixing channels of the stereophonic program. A mode control is coupled to the playback circuit and to the audio headset. The mode control detects when at least one of the two earpieces is not adjacent a listener's ear and causes the playback circuit to deliver the monaural program to the audio headset.

12 Claims, 2 Drawing Sheets

AUDIO PLAYER WITH MONOPHONIC MODE CONTROL

BACKGROUND

1. Field

Embodiments of the invention relate to the field of audio playback; and more specifically, to the control of audio playback for a headphone listener.

2. Background

A listener may utilize a headset in order to receive an audio program in private and personalized manner. Headsets typically include a right earpiece and a left earpiece coupled to a right and left channel of audio, respectively.

There may be times when the listener may wish to listen to the audio program with only one of the two earpieces. For example, the listener may wish to leave one ear available for better perception of ambient sounds. As another example, the listener may wish to share the earpieces with a second listener, particularly for headsets of the "ear bud" type, where each listener is listening to the audio program with only one of the two earpieces.

It would be desirable to provide a way to effectively use headphones to listen to an audio program with only one of the two earpieces.

SUMMARY

An audio player includes an audio headset having two earpieces. A playback circuit provides one of a stereophonic program and a monaural program to the audio headset. The monaural program may be created by mixing channels of the stereophonic program. A mode control is coupled to the playback circuit and to the audio headset. The mode control detects when at least one of the two earpieces is not adjacent a listener's ear and causes the playback circuit to deliver the monaural program to the audio headset.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

Figure 1:
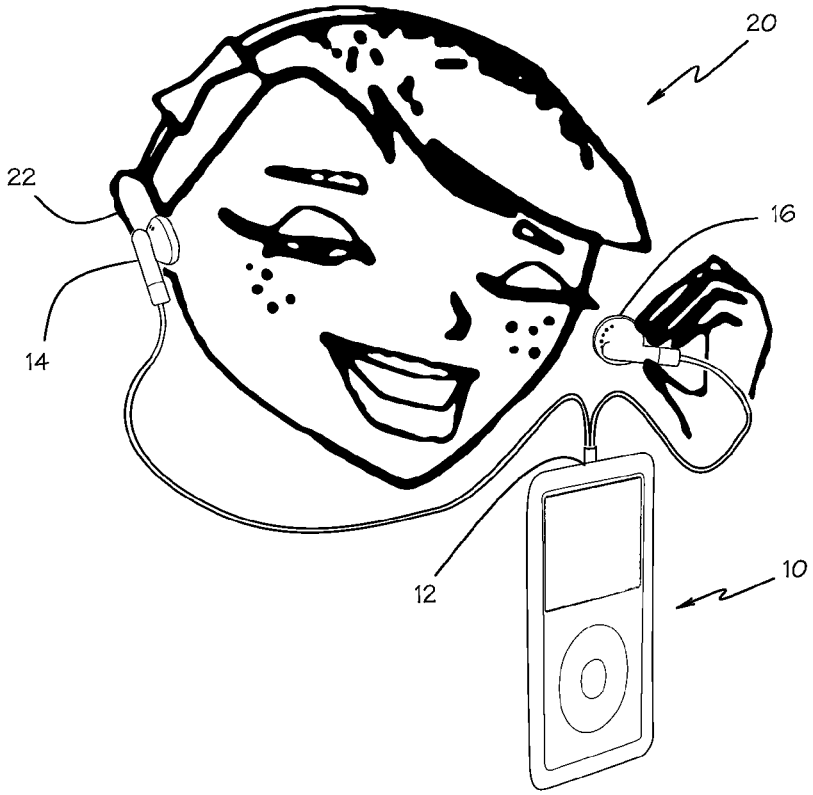
FIG. 1 is a pictorial representation of a listener using an audio player that embodies the invention.

FIG. 1 shows an audio player 10 that includes an audio headset with two earpieces 14, 16. While an "ear bud" type of headset with the two earpieces coupled only by an electrical cable is shown, it will be appreciated that the headset may be of any type that provides two earpieces, such as a headset where the two earpieces are coupled by an elastic member that holds the earpieces against the ears 22 of a listener 20.

The audio player may be a device that plays audio material such as a CD player, an MP3 player, or the like. The audio player may also be a device that plays multimedia content such as DVDs or video files that include an audio program or any other device that provides an audio program to an audio headset. The audio player may be part of a device that provides other functions in addition to playing audio material, such as a mobile telephone, personal digital assistant, or portable computer. The audio headset may be detachably coupled to the audio player 10 at an audio port 12, such as being coupled by a phone plug inserted into an audio output jack. The audio headset may be an alternate listening device and the audio device may also include loudspeakers or other devices for delivery of the audio program to the listener.

Figure 2:
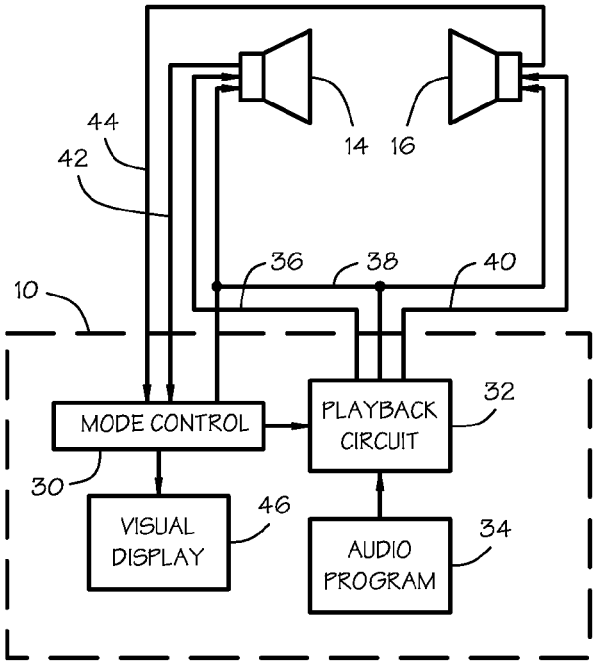
FIG. 2 is a block diagram of circuits that may be used in an audio player that embodies the invention.

FIG. 2 shows a block diagram of circuits that may be included in the audio player 10. An audio program circuit 34 provides the source material to be delivered to the listener. A playback circuit 32 is coupled to the audio program circuit 34. The playback circuit 32 is coupled to the audio headset 14, 16. The playback circuit 32 provides one of a stereophonic program or a monaural program to the audio headset 14, 16 by processing the source material provided by the audio program circuit 34. The playback circuit 32 may be coupled to the audio headset 14, 16 by wires where a first pair of wires 36, 38 delivers a portion of the audio program to one of the two earpieces 14 and a second pair of wires 40, 38 delivers another portion of the audio program to the other of the two earpieces 16. One wire 38 of the first and second pairs of wires may be a common connection to the playback circuit 32.

A mode control circuit 30 is coupled to the playback circuit 32 and to the audio headset 14, 16. The connection to the audio headset may be through an additional wire 42, 44 from each of the two earpieces. The mode control detects when at least one of the two earpieces 14, 16 is not adjacent the listener's ear. "Adjacent the listener's ear" is used to mean that an earpiece is in a normal or typical listening position in or against the listener's ear. When the earpiece is not adjacent the listener's ear it may still be audible to the listener as it is held in the listener's hand or is otherwise supported away from the listener's ear.

The mode control may be use any of a variety of means for detecting if an earpiece 14 is adjacent the listener's ear 12, such as impedance detection, touch sensing, proximity sensing, pressure sensing, etc. For example, co-pending U.S. patent application Ser. No. 12/277,219, entitled "Detecting the Repositioning of an Earphone Using a Microphone and Associated Action" and assigned to the same entity as the present application, discloses detecting a pressure change caused by the repositioning of an earphone as a means for detecting if an earpiece is adjacent a listener's ear. In another example, each earpiece may include a pressure activated switch that is closed when an earpiece 14 is adjacent the listener's ear 12. The switch circuit may share a common wire 38 with the wires used to deliver the audio program. In other embodiments, the mode control may detect "touch" by a change in an electrical parameter, such a capacitance or resistance, that varies when the earpiece 14 is adjacent the listener's ear 12 due to the capacitance effect of the listener or resistance of the listener's skin. The mode control may sense proximity where an earpiece is close to, but not touching, the listener's ear. Alternatively, the electrical parameter may be a resistance of a conductive rubber or foam pad on the earpiece where the resistance changes as the pad is compressed when the earpiece 14 is adjacent the listener's ear 12. For an audio headset of the "ear bud" type in which each of the two earpieces are designed to be inserted into an ear canal of the listener, each earpiece may provide a signal to indicate that the earpiece is adjacent the listener's ear when inserted into the ear canal.

The mode control circuit 30 causes the playback circuit 32 to deliver the monaural program to the audio headset when at least one of the two earpieces 14, 16 is not adjacent a listener's ear 12. The playback circuit 32 may provide the monaural program to the audio headset 14, 16 by mixing channels of the stereophonic program provided by the audio program circuit 34. When the mode control circuit 30 detects that both of the two earpieces 14, 16 are adjacent the listener's ears 12, it causes the playback circuit 32 to deliver the stereophonic program to the audio headset.

Figure 3:
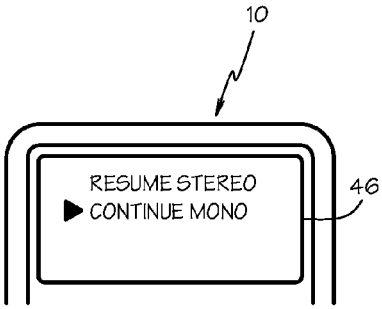
FIG. 3 is an illustration of a display that provides a user selection.

The mode control circuit 30 may be coupled to a visual display 46 that can display information to the listener 20 of the audio player 10. As shown in FIG. 3, the mode control circuit 30 may provide a user selection on the visual display 46 to continue delivering the monaural program to the audio headset even if the mode control detects that both of the two earpieces are adjacent the listener's ears, the mode control providing the user selection when at least one of the two earpieces is not adjacent a listener's ear. Thus the listener may elect to have the audio player continue delivering the monaural program to the audio headset regardless of positions of the two earpieces with respect to the listener's ears after the delivery of the monaural program is initiated by removing at least one of the two earpieces 14, 16. This may be advantageous if the listener anticipates the need to frequently remove an earpiece to listen with only one ear or if the listener wishes to share the second earpiece with a second listener.

Figure 4:
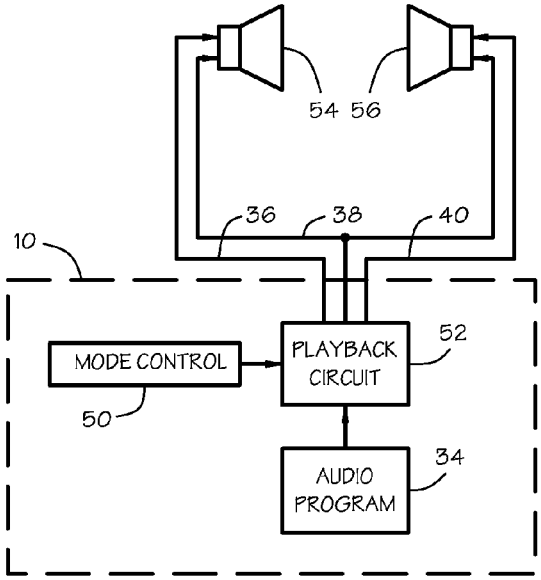
FIG. 4 is a block diagram of alternative circuits that may be used in an audio player that embodies the invention.

FIG. 4 shows another embodiment of a mode control circuit 50 that is coupled to a playback circuit 52 and to an audio headset 54, 56. Each of the two earpieces 54, 56 are designed to be inserted into an ear canal of the listener. The playback circuit 52 senses a change in an impedance of the audio driver element for each of the two earpieces 54, 56 when inserted into the ear canal of the listener. The mode control circuit 50 uses the change in the impedance of the audio driver element to detect when at least one of the two earpieces 54, 56 is not adjacent the listener's ear. The playback circuit 52 may further sense a difference in the impedance of the audio driver element for each of the two earpieces when inserted into ear canals of two listeners. The mode control circuit 50 may cause the playback circuit 52 to deliver the monaural program to the audio headset responsive to the difference in the impedances of the audio driver element.

Figure 5:
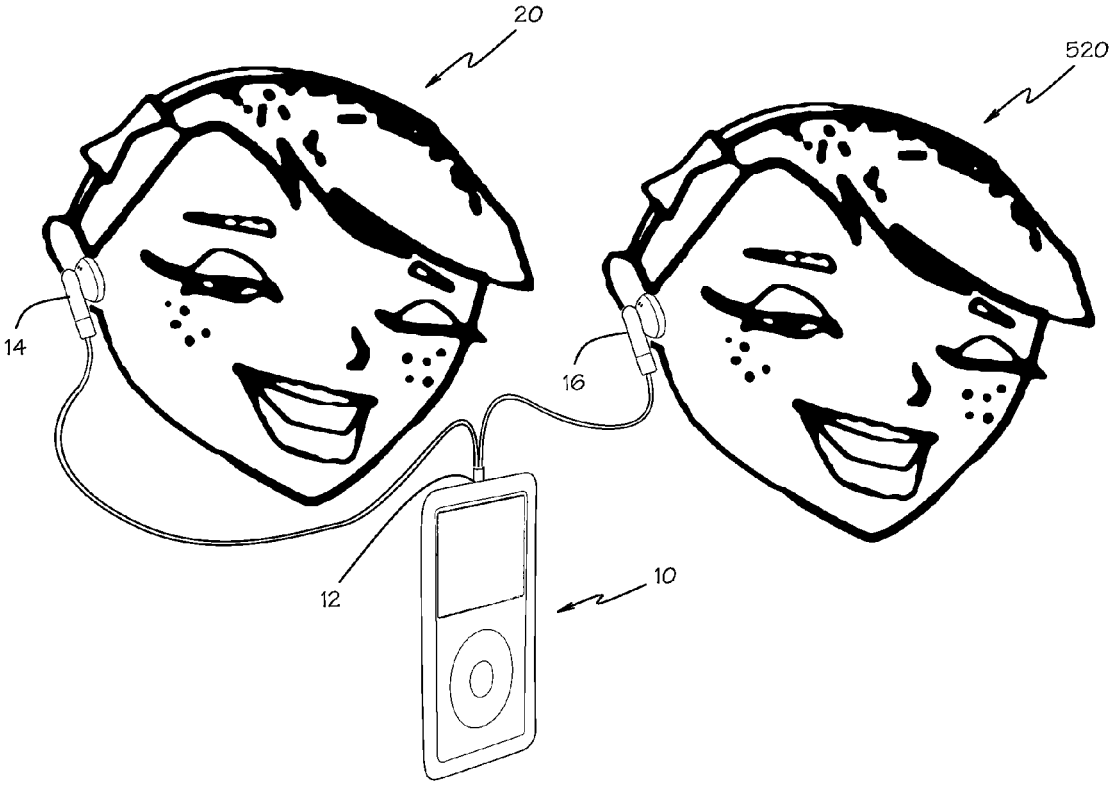
FIG. 5 is a pictorial representation of two listeners sharing earpieces of an audio player that embodies the invention.

FIG. 5 shows the audio player 10 with the earpieces 14, 16 being shared with a second listener 520. The playback circuit 52 may sense a difference in the impedance of the audio driver element for each of the two earpieces 14, 16 when inserted into ear canals of the two listeners 20, 520. The mode control circuit 50 may cause the playback circuit 52 to deliver a monaural program to the audio headset 14, 16 responsive to the difference in the impedances in the two earpieces.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. An audio player comprising:

an audio headset including two earpieces each designed to be inserted into an ear canal of a listener, each earpiece including an audio driver element to deliver an audio program to the listener;

a playback circuit coupled to the audio headset, the playback circuit being capable of providing a stereophonic program and a monaural program to the audio headset, the playback circuit to sense a difference between the impedances of the audio driver elements in the two earpieces; and a mode control coupled to the playback circuit and to the audio headset, the mode control to use the sensed impedance difference to detect when at least one of the two earpieces is not adjacent a listener's ear and in response cause the playback circuit to deliver the monaural program to the audio headset, instead of the stereophonic program.

2. The audio player of claim 1, wherein the playback circuit provides the monaural program to the audio headset by mixing channels of the stereophonic program.

3. The audio player of claim 1, wherein the mode control is further to use a lack of sensed impedance difference to detect when both of the two earpieces are adjacent the listener's ears and in response cause the playback circuit to deliver the stereophonic program to the audio headset, instead of the monaural program.

4. The audio player of claim 1, wherein the mode control further provides a user selection to continue delivering the monaural program to the audio headset even if the mode control detects a lack of impedance difference, the mode control providing the user selection when the difference between the impedances is sensed.

5. A method of controlling an audio player, the method comprising:

connecting an audio headset including two earpieces to an audio output jack on the audio player;

sensing a difference between the impedances of audio driver elements that deliver an audio program to the listener in the two earpieces; and delivering a monaural program, instead of a stereophonic program, to the two earpieces of the audio headset in response to the sensed impedance difference.

6. The method of claim 5, further comprising mixing channels of a stereophonic program to produce the monaural program.

7. The method of claim 5, further comprising delivering a stereophonic program, instead of a monaural program, to the two earpieces of the audio headset in response to a lack of sensed impedance difference.

8. The method of claim 5, further comprising providing a user selection when the difference between the impedances is sensed, the user selection to cause delivery of the monaural program to the audio headset to continue even if there is a lack of sensed impedance difference.

9. An audio player comprising:

means for connecting an audio headset including two earpieces to the audio player;

means for sensing a difference between the impedances of audio driver elements that deliver an audio program to the listener in the two earpieces; and means for delivering a monaural program, instead of a stereophonic program, to the two earpieces of the audio headset in response to the sensed impedance difference.

10. The audio player of claim 9, further comprising means for mixing channels of a stereophonic program to produce the monaural program.

11. The audio player of claim 9, further comprising means for delivering a stereophonic program, instead of a monaural program, to the two earpieces of the audio headset in response to a lack of sensed impedance difference.

12. The audio player of claim 9, further comprising means for providing a user selection when the difference between the impedances is sensed, the user selection to cause delivery of the monaural program to the audio headset to continue even if there is a lack of sensed impedance difference.

* * * * *